United States Patent [19]

Carlson

[11] 4,082,187

[45] Apr. 4, 1978

[54] MEANS AND METHOD FOR PACKAGING FRANGIBLE ARTICLES

[75] Inventor: Bayard L. Carlson, Wilsonville, Oreg.

[73] Assignee: AMFAC Foods, Inc., Portland, Oreg.

[21] Appl. No.: 739,085

[22] Filed: Nov. 5, 1976

[51] Int. Cl.[2] ..... B65D 85/36; B65D 81/08

[52] U.S. Cl. ..... 206/585; 206/454; 206/526; 206/586; 206/806; 206/822; 220/23.6; 220/23.83; 220/72; 220/74; 229/DIG. 11; 426/108; 53/202; 53/3

[58] Field of Search ..... 220/72, 74, 23.4, 23.6, 220/23.83; 206/585, 586, 593, 504, 526, 454, 806, 822; 426/129; 52/108; 229/DIG. 11; 53/202, 3

[56] References Cited

U.S. PATENT DOCUMENTS

| | | | |
|---|---|---|---|
| 888,855 | 5/1908 | Sisco | 206/593 |
| 2,027,342 | 1/1936 | Hopkins | 206/526 |
| 2,644,443 | 7/1953 | Barnsteiner | 220/72 |
| 2,835,594 | 5/1958 | Felt et al. | 426/108 |
| 2,974,789 | 3/1961 | Reifers | 206/504 |
| 3,351,265 | 11/1967 | Miller | 426/129 |
| 3,385,678 | 5/1968 | Sorenson | 206/504 |
| 3,389,825 | 6/1968 | Whiteford | 220/23.4 |
| 3,419,176 | 12/1968 | Lipfert et al. | 206/504 |
| 3,563,445 | 2/1971 | Clayton | 220/72 |
| 3,759,416 | 9/1973 | Constantine | 220/72 |

*Primary Examiner*—William Price
*Assistant Examiner*—Joseph M. Moy
*Attorney, Agent, or Firm*—Klarquist, Sparkman, Campbell, Leigh, Hall and Whinston

[57] ABSTRACT

A system of packaging frozen onion rings and other frangible articles for transport and storage is disclosed. Vacuum formed polystyrene packages having a shock absorbing flange are stacked in rigid walled shipping containers, each package resting with a downwardly protruding edge of its flange on a rigid horizontal surface. Special purpose packages having troughs for cradling rectangular articles are also disclosed.

18 Claims, 9 Drawing Figures

FIG. 1
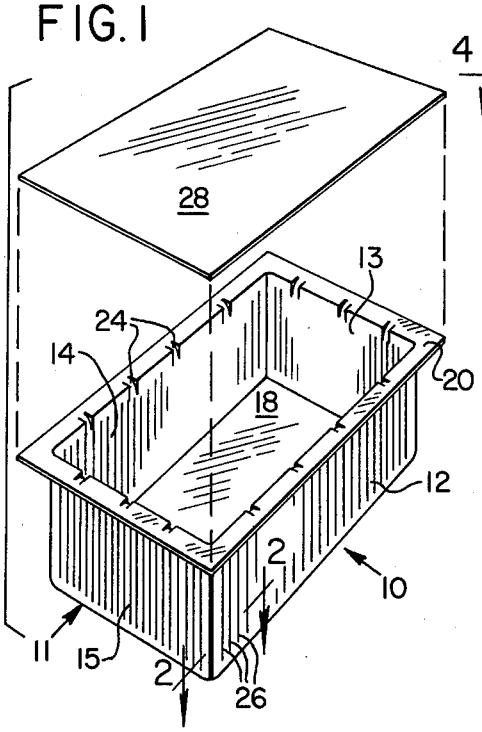
FIG. 3
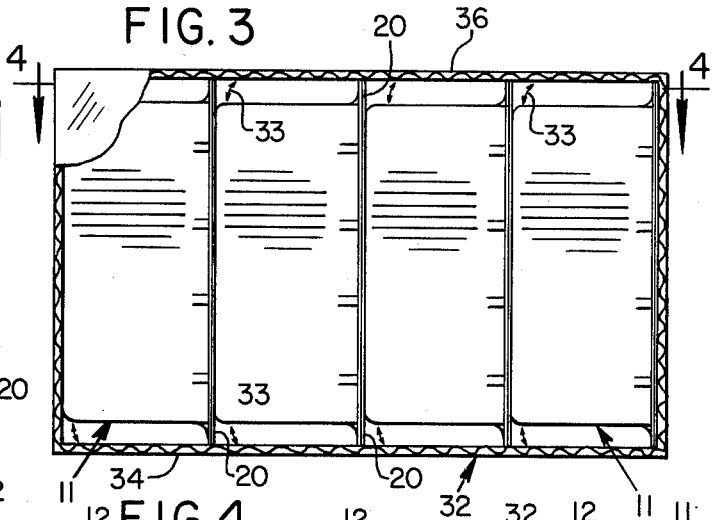
FIG. 4
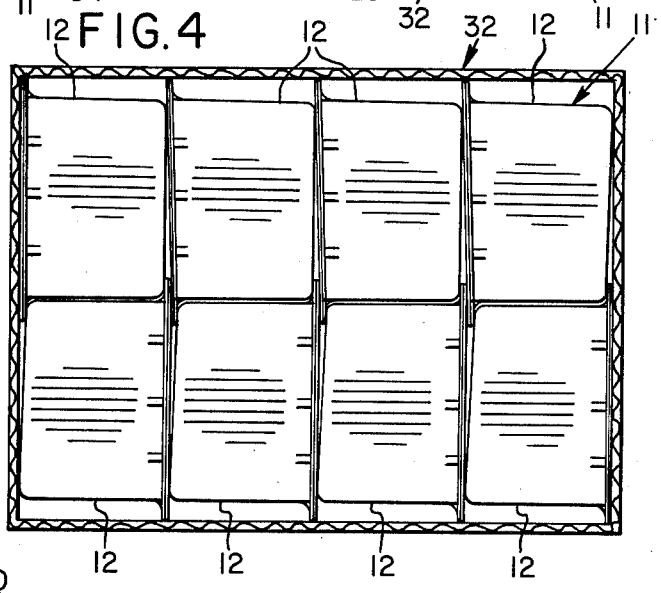
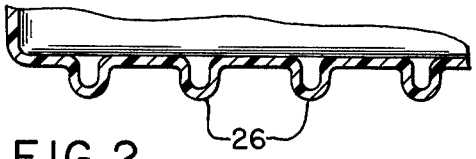
FIG. 2
FIG. 5
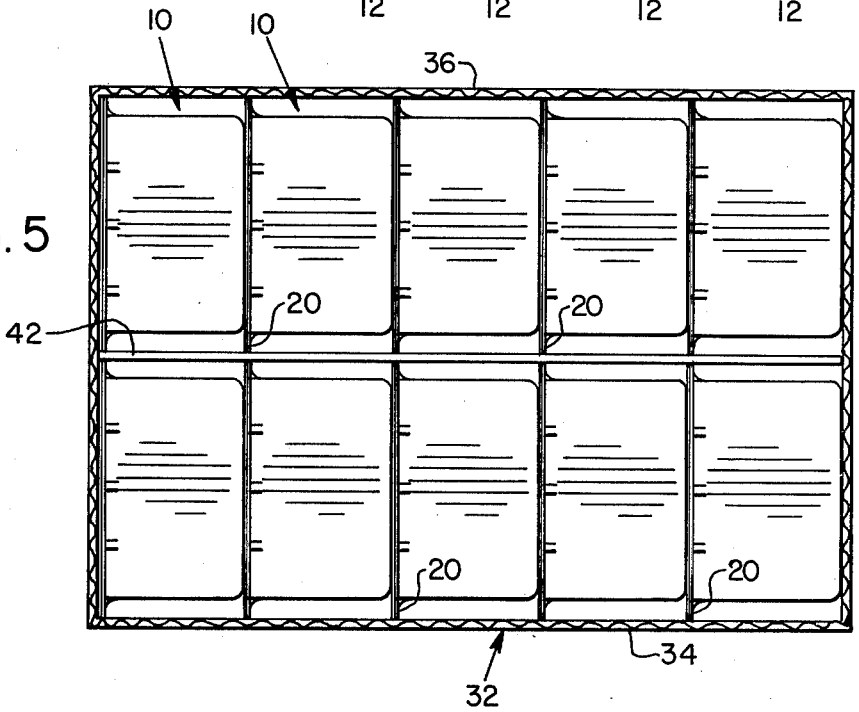

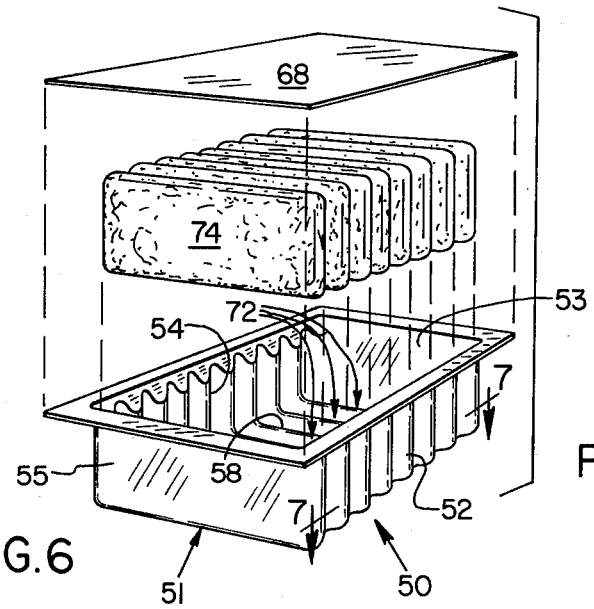
FIG.6
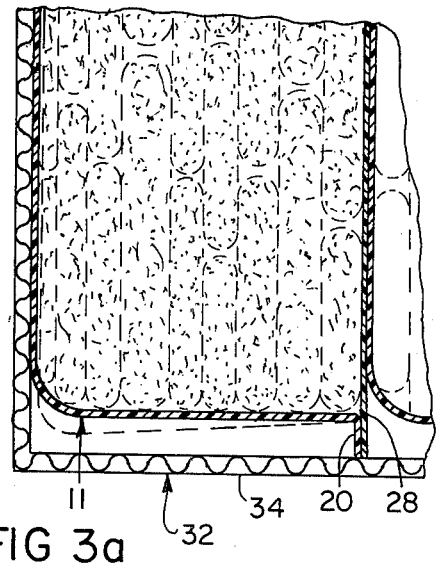
FIG 3a
FIG.7
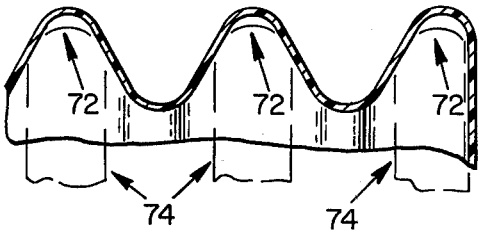
FIG.8
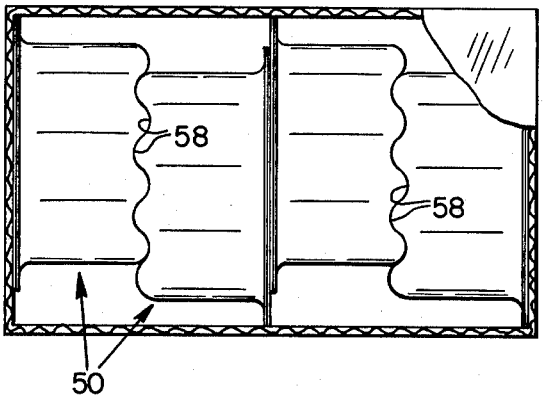

MEANS AND METHOD FOR PACKAGING FRANGIBLE ARTICLES

BACKGROUND OF THE INVENTION

The present invention relates to packages for frangible food products and more specifically to a system for shipping multiple packages of a processed frozen food product such as breaded onion rings, fruit pies and the like.

Due to the fragility of many frozen food products, the manner in which such products are packaged for shipping has a large effect upon their condition after transit from point of origin to the ultimate consumer.

Presently such food products are packaged in sacks made of plastic, paper or foil. Several of these sacks are placed inside a cardboard shipping container and then transported in this condition. A significant amount of product breakage occurs during the transit of such packages because articles in a given package abrade or collide whenever the shipping container is jarred. At the present time, the best solution to the breakage problem has been to hand pack the fragile articles in layers between sheets of paper so that each article is separated from all others. Although breakage is reduced by such a technique, the expense of hand packing relatively inexpensive articles, such as frozen onion rings, is prohibitive.

SUMMARY OF THE INVENTION

A packaging system has now been discovered which employs vacuum formed plastic packages, filled by machine, to reduce breakage of frangible articles during shipping without a substantial increase in packaging costs as compared to bag pack packaging systems.

The packages, which have a tub shaped body portion and a peripheral flange, are filled with the frangible product and then placed in a shipping container. Each package is positioned in the container with one edge of its flange resting on a rigid horizontal surface. The flange serves as a shock absorbing support which reduces the abrasive effect jolts to the shipping container have on the frangible product.

It is an object of the present invention to provide a machine packaging system for frangible articles whereby product breakage during shipping is minimized.

A further object is to provide packages which suspend frangible articles above the bottom wall and below the top wall of a shipping container so that the articles are not directly subject to impacts on the container.

An additional object is to provide packages having multiple cradling compartments each of which is adapted to receive one of multiple uniformly shaped articles.

Other objects will be apparent from the following description.

BRIEF DESCRIPTION OF THE DRAWINGS

In the drawings:

FIG. 1 is an exploded perspective view of a flanged package according to the present invention;

FIG. 2 is a fragmentary sectional view of a side panel of the package taken along line 2—2 of FIG. 1 on an enlarged scale;

FIG. 3 is a side view of a shipping container, containing a plurality of the packages shown in FIG. 1, with one of its sides partly broken away;

FIG. 3A is an enlarged fragmentary side view of the shipping container shown in FIG. 3, with one of its sides broken away and showing part of one of its packages in section.

FIG. 4 is a horizontal sectional view taken along line 4—4 of FIG. 3;

FIG. 5 is a side view on a reduced scale of a shipping container containing multiple layers of the packages shown in FIG. 1 with one of its sides partly broken away;

FIG. 6 is an exploded perspective view of a special purpose package which is a variation of the package shown in FIG. 1;

FIG. 7 is a fragmentary sectional view on an enlarged scale taken along line 7—7 of FIG. 6; and FIG. 8 is a top view of a shipping container containing a plurality of the packages shown in FIG. 6, with a portion of the top wall broken away.

DESCRIPTION OF THE PREFERRED EMBODIMENTS

The basic packaging unit of the present invention is shown in FIG. 1. This two piece package indicated generally at 10 includes a body portion 11 shaped like a rectangular box having an open side, side panels 12–15 surrounding the open side and a back panel 18 which is opposite the open side. Extending outwardly from the body portion, perpendicularly to the side panels at the edges of the side panels nearest the open side is a flange 20. Gussets 24 are optionally positioned between the side panels and the flange 20 for supporting the flange in a fixed angular relationship to the side walls. Gussets are not required if the packaged article are lightweight or if the package is constructed of sufficiently rigid materials. The side walls 12–15 perferably include ribbing 26 as shown in FIG. 2. The ribbing 26 increases the strength and rigidity of the sidewalls and also effects the amplitude of the tub portion's movement. A flat lid portion 28 is sealed to the flange 20 after the articles to be shipped are inserted into the interior of the body portion 11.

The body and lid of the package shown in FIG. 1 may be constructed from any material which can be formed into the desired shapes. It is necessary that the flange 20 be sufficiently rigid to support the body portion and enclosed article. For optimal shock absorption, however, it is necessary that the flange be formed of a somewhat flexible material or that it be flexibly joined to the body portion. Most plastic sheet materials display the desired semi-rigidity if a suitable sheet thickness is chosen. Many plastics are additionally advantageous in that they are transparent and thus allow easy observation of package contents. Laminates of paper or foil are other materials may be suitable if they possess the proper characteristics.

According to the preferred embodiment of the present invention, flanged body portions constructed from vacuum formable sheets of oriented polystyrene ten mils thick and lid portions cut from 7½ mil sheets of the same material are heat sealed together. The resulting package has a flange and lid combination 17½ mils thick, which displays the desired semi-rigidity. When these packages, containing frozen breaded onion rings, are properly arranged in a rigid walled shipping container, product breakage during shipment is reduced.

FIGS. 3 and 4 show the packages of FIG. 1 enclosed in a suitable rigid walled shipping container 32. The walls of the container preferably comprise corrugated paper board, but other rigid materials would work equally well.

The positioning of the packages inside the shipping container 32 is critical to the success of packaging system. It is essential that each of the packages of FIG. 1 rest on the edge of its flange as shown in FIG. 3 so that the flange 20 can serve as a shock absorbing support or cushion which maintains the body portion 11 in an elevated position above the bottom wall 34 of the shipping container. In addition the top wall 36 of the shipping container should rest on that portion of the flange 20 which extends from the top of each package. According to this arrangement, the packages are wedged between the top and bottom walls of the shipping container 32 so that both horizontal and vertical movement of the flanges 20 is restricted, but the body portions 11 are free to move up and down inside the container in response to jolts which occur during shipping. Because the body portion 11 is suspended above the bottom wall 34 and below the top wall 36, it is free to swing as shown by arrows 33 in FIG. 3, between the positions shown by solid and broken lines in FIG. 3A; without contacting either the top or bottom walls. This capacity for vertical movement without contacting a rigid surface and without substantially altering the shape of the body portion 11 is believed responsible for the reduction in breakage observed in comparison tests between the packaging system according to the present invention and prior bag type systems.

Any number of packages can be included in a one layer shipping container so long as each of the packages rests on one of its flanged edges. The packages occupy a minimum volume if arranged in rows. In one such arrangement packages in each row are positioned in a head to tail array whereby all the packages in a given row are similarly oriented with the back panel of each package facing the lid or an adjacent package in the same row. FIG. 4 is a top view which shows a rectangular box containing two rows of packages in the head to tail array. To further conserve space, the lid portions of packages in adjacent rows of the array face in opposite directions. Although other horizontal arrangements are possible, it is believed that the array shown in FIG. 4 is the most dense possible using packages of the type shown in FIG. 1. The horizontal arrangement shown in FIG. 4 is especially advantageous because the packages 10 are positioned with their side panels 12 out of contact with the sides of the container 32. When this arrangement is used, the flanges 20 which extend outwardly from the side panels 12 contact the sides of the container and thus serve as shock absorbers to dampen lateral jolts on the shipping container 32.

It is possible to include multiple layers of packages in a given shipping container. In order to do so, however, it is necessary to provide rigid platforms so that packages in each of the upper layers can rest on the edges of their flanges. FIG. 5 shows an arrangement in which two layers of packages are included in a single shipping carton. In this embodiment a rigid, horizontal divider sheet 42 is positioned on top of the first layer of packages. This divider sheet provides a platform for the second layer of packages. In this embodiment, it is preferred that the top wall 36 of the shipping container be in contact with the edges of the flanges extending upwardly from the packages in the upper layer.

A special purpose package 50 for transporting rectangular fruit pies and other similarly shaped articles is shown in FIG. 6. This package includes a body portion 51 having side panels 52–55 and a back panel 58, which panels correspond to similarly named panels of the package shown in FIG. 1, and also includes a lid portion 68.

The special purpose package 50 differs from the package 10 in that the body portion 51 additionally includes multiple corrugations which extend from points adjacent the flange on one of the side panels 52, across the back panel 58, and along the opposite side panel 54 to points adjacent the flange. These corrugations define indentations or troughs 72 which are adapted to receive and cradle rectangular articles 74 during shipping and storage.

Like the packages 10, the special purpose corrugated packages 50 are conveniently positioned in rows inside a shipping container. As previously described, every such package must rest on a flanged edge in order to achieve the desired cushioning effect. The maximum density arrangement of corrugated packages 50 is somewhat different, however, than that of the packages 10. FIG. 8 is a top view which illustrates the most dense packaging pattern for a single row of corrugated packages 50. In this array, adjacent packages in the row are positioned back to back so that their corrugated back panels 58 interlock. When the special purpose packages 50 are arranged in this back to back array it is important that the troughs be vertically oriented as shown in the top view, FIG. 8. If the troughs are horizontally oriented, the vertical motion of the tub portions 50 will be restricted and shock absorbing effect of the flange reduced. Multiple layers of corrugated packages may be included in a single shipping container by including a rigid divider sheets as previously described.

In operation packaging is accomplished by filling the body portion of the package with the frangible articles to be shipped and then heat sealing, cementing or otherwise attaching the lid to the flange thereby closing the open side of the package. The packages are positioned inside the rigid walled shipping container with each package resting on a flange so that the body portion is elevated above the floor of the box. The top wall of the shipping container is closed, wedging the enclosed packages into position. The container is maintained in an upright position during transit to its intended destination so that the packages contained inside are suspended during the entire trip.

In order to test the performance of the present invention, shipping tests were made to compare the prior bag pack with the tray pack of the present invention. In those tests, cases containing bag packaged onion rings were shipped along with cases containing vertical tray packaged onion rings.

In a first test run, sample cases of frozen breaded onion rings were shipped from Weston, Oregon to a distributor in Bettendorf, Iowa. A portion of these cases were further transferred to retailers in the Columbus, Ohio area. In a second test run, cases of frozen breaded onion rings were shipped from Weston, Oregon to a Seattle, Washington distributor. A portion of these packages were then forwarded to various Seattle area retail units. The contents of the sample cases were graded when they reached their ultimate destination to determine the percent of broken onion rings by weight. The tray pack cases according to the present invention included $17\frac{3}{4}$ pounds of onion rings divided among 10 packages. The packages were positioned in the shipping containers in the arrangement shown in FIGS. 3 and 4. The bag package cases included twenty pounds of onion rings divided among eight bag packages which were lined up in two rows of four. The results of these shipping tests are summarized in the Table below:

| | Bag Pack | Tray Pack |
|---|---|---|
| Seattle Test | | |
| Distributor Level | | |
| Ave. wt. % broken | 3.49 | 1.60 |
| Percent of packages having more than 10 wt. % broken | 3.1 | 0 |
| Retail Unit Level | | |
| Ave. wt. % broken | 5.14 | 2.06 |
| Percent of packages having more than 10 wt. % broken | 8.3 | 0.8 |
| Columbus Test | | |
| Distributor Level | | |
| Ave. wt. % broken | 5.88 | 2.49 |
| Percent of packages having more than 10 wt. % broken | 14.6 | 2.1 |
| Retail Unit Level | | |
| Ave. wt. % broken | 8.21 | 2.49 |
| Percent of packages having more than 10 wt. % broken | 31.2 | 3.3 |

It was observed that bag packages leaving Weston, Oregon had about one weight percent more broken onion rings than the tray packages. The figures in the above table, after correction to account for this predistribution difference, indicate that 0.89 weight percent fewer onion rings were broken during shipment to the Seattle distributor in tray packages. Likewise, 2.39 weight percent fewer onion rings were broken when the tray pack was used in the Columbus shipment. As can be seen from the table, the difference in breakage was even greater at the retail level. Also significant was the large difference in the percent of packages having greater than 10 weight percent breakage. Individual packages having a large number of broken particles are a major source of customer dissatisfaction. The use of the present invention substantially reduces the possibility that a customer will obtain a package containing more than ten weight percent of broken onion rings.

While I have shown and described preferred embodiments of my invention, it will be apparent to those skilled in the art that changes and modifications may be made without departing from my invention in its broader aspects.

I claim:

1. A packaging system for shipping frangible articles comprising:

a rigid-walled shipping container having a plurality of sidewalls and opposed top and bottom walls, at least one package within said container, said package having a body portion containing one or more frangible articles, said package including a shock-absorbing means for cushioning said articles during shipment to inhibit their breakage, said shock-absorbing means comprising:

flange means extending outwardly from and generally transversely of an adjacent said body portion of said package;

said body portion selected from a material and thickness of material providing a controlled flexing thereof relative to said flange means while having a self-supporting capability, said package being arranged and supported generally on its side during shipment with its flange means engaging said bottom wall and supporting said body portion in cantilevered relationship above said bottom wall, the cantilevered length of said body portion from its supporting flange means, and the width of said flange means being selected in relation to the total weight to be imposed on and carried by the body portion during shipment so as to provide a controlled deflection of said body portion relative to its supporting flange means toward said bottom wall without contacting said bottom wall when said container is jolted during shipment.

2. A system according to claim 1 wherein said flange means extends upwardly from said body portion into contact with an overhead horizontal wall means of said container to space said body portion below said overhead wall means, and thereby inhibit vertical displacement of said package while permitting upward deflection of said body portion without contacting said overhead wall means during shipment.

3. A system according to claim 1 wherein said walls comprise sheets of paperboard assembled to form a rectilinear container.

4. A system according to claim 1 wherein said package includes:

a body portion shaped like a rectangular box having an open side, side panels surrounding said open side and a back panel opposite said open side, said body portion also having a flange which extends perpendicularly to and outwardly from the side panels at the edges thereof nearest said open side, and a flat lid portion attachable to said flanges to close a compartment defined by said body portion.

5. A system according to claim 4 wherein said portions comprise a flexible plastic material.

6. A system according to claim 5 wherein said plastic material comprises high impact polystyrene.

7. A system according to claim 4 wherein said body portion has multiple corrugations which extend from points adjacent said flange on one side panel along said one side panel toward said back panel, across said back panel, and along the side panel opposide said one side panel to points adjacent said flange on said opposite side panel, said corrugations defining troughs adapted to receive and cradle rectangular articles.

8. A system according to claim 7 wherein a plurality of said packages are lined up in at least one row within said container with said corrugations across said back panel extending vertically and with adjacent packages in a given row facing in opposite directions such that the lid portion of a given package faces the lid portion of one adjacent package in the same row and the corrugated back panel of said given package faces and intermeshes with the corrugated back panel of another adjacent package in the same row.

9. A system according to claim 4 wherein a plurality of said packages are lined up in at least one row within said container.

10. A system according to claim 9 wherein;

said packages are lined up in a plurality of parallel rows of equal length;

all of the packages in a given row are similarly oriented with the back panel of each package facing the lid portion of an adjacent package in the same row; and packages in adjacent rows face in opposite directions.

11. A system according to claim 4 wherein said back panel includes multiple indentations, each of said indentations being adapted to receive and cradle one of multiple uniformly shaped frangible articles.

12. A system according to claim 4 wherein said side panels include multiple ribs for stiffening said panels.

13. A system according to claim 1 further comprising multiple gussets formed between said body portion and said flange means to aid in controlling the degree of deflection of said body portion relative to said flange means with the package in its shipping position.

14. A system according to claim 1 wherein there are a plurality of packages within said container arranged vertically in layers, a rigid horizontal divider sheet positioned between each pair of vertically adjacent layers and supported on the flange means of packages of the lower layer of each pair, the packages in the upper layer of each pair being positioned with their flange means engaging said divider sheet and their body portions elevated above said divider sheet.

15. A system according to claim 14 wherein the packages in the uppermost layer in said container have their flange means contacting said top wall to prevent vertical displacement of said layers within said container while permitting vertical deflection of the body portions of said packages without contacting said divider sheets and said top and bottom walls.

16. A method of packaging frangible articles comprising:

enclosing said article in the body portion of a package, providing the package with shock-absorbing means for cushioning the packaged articles during shipment to inhibit their breakage, with the shock-absorbing means including a flange means extending outwardly from and generally transversely of the body portion and a body portion selected from a material and thickness of material giving the body portion a controlled flexibility relative to the flange means while having a self-supporting capability, containing said package within a rigid-walled shipping container having sidewalls and opposite top and bottom walls, with the package arranged and supported generally on its side within the container, positioning the package along the bottom wall of the container with its flange means engaging the bottom wall to support its body portion in cantilevered relation to said flange means above said bottom wall, and dimensioning the package so that the cantilevered length of its body portion from its supporting flange means and the width of its supporting flange means in relation to the total weight to be imposed on and carried by the body portion during shipment provides a controlled deflection of the body portion relative to its supporting flange means toward the bottom wall without contacting the bottom wall when the container is jolted during shipment.

17. A method according to claim 16 further comprising maintaining said shipping container in an upright position during the shipment thereof to its desired destination.

18. A method according to claim 16 further comprising positioning additional similar packages inside said container with the outer edges of their flange means resting on said bottom wall and with their flange means also extending upwardly into contact with an overhead horizontal wall means of the container to inhibit vertical displacement of the containers during shipment.

* * * * *